US008522514B2

(12) United States Patent
George

(10) Patent No.: US 8,522,514 B2
(45) Date of Patent: Sep. 3, 2013

(54) BEVERAGE CONTAINERS HAVING COATED LABELS WITH MODIFIED GAS BARRIER PROPERTIES AND RELATED METHODS

(75) Inventor: Patrick George, Plano, TX (US)

(73) Assignee: Dr Pepper/Seven Up, Inc., Plano, TX (US)

( * ) Notice: Subject to any disclaimer, the term of this patent is extended or adjusted under 35 U.S.C. 154(b) by 471 days.

(21) Appl. No.: 12/822,959

(22) Filed: Jun. 24, 2010

(65) Prior Publication Data

US 2011/0314772 A1 Dec. 29, 2011

(51) Int. Cl.
*B65B 61/00* (2006.01)

(52) U.S. Cl.
USPC ..... 53/136.1; 53/411

(58) Field of Classification Search
USPC ..... 53/411, 415, 135.1, 136.1
See application file for complete search history.

(56) References Cited

U.S. PATENT DOCUMENTS

| | | | | |
|---|---|---|---|---|
| 3,864,151 | A | 2/1975 | Shonebarger et al. | |
| 4,016,706 | A * | 4/1977 | Braker et al. | 53/411 |
| 5,041,303 | A * | 8/1991 | Wertheimer et al. | 427/575 |
| 5,240,529 | A * | 8/1993 | Hoffman | 156/86 |
| 5,507,525 | A | 4/1996 | Leuenberger | |
| 5,662,985 | A * | 9/1997 | Jensen et al. | 428/195.1 |
| 6,296,129 | B1 * | 10/2001 | Kawasaki | 215/12.1 |
| 6,485,803 | B1 * | 11/2002 | Bright | 428/35.1 |
| 6,596,359 | B2 * | 7/2003 | Roth et al. | 428/40.1 |
| 6,641,914 | B2 * | 11/2003 | Lu | 428/355 AC |
| 6,749,785 | B2 | 6/2004 | Subramanian et al. | |
| 6,789,373 | B2 * | 9/2004 | Bourdelais et al. | 53/411 |
| 6,827,972 | B2 | 12/2004 | Darras et al. | |
| 7,581,942 | B2 | 9/2009 | Richards et al. | |
| 7,802,600 | B2 * | 9/2010 | Kobayashi | 156/387 |
| 8,105,686 | B2 * | 1/2012 | Blackwell et al. | 428/355 AC |
| 2005/0235607 | A1 * | 10/2005 | Van Den Heuvel et al. | 53/415 |
| 2006/0086745 | A1 * | 4/2006 | Morrison | 220/737 |
| 2008/0197540 | A1 * | 8/2008 | McAllister et al. | 264/342 R |
| 2011/0315267 | A1 * | 12/2011 | Bentley | 141/1 |

FOREIGN PATENT DOCUMENTS

US 20100040904 A1 2/2010

OTHER PUBLICATIONS

Alexander et al. "Plasma Polymer Chemical Gradients for Evaluation of Surface Reactivity: Epoxide Reactions with Carboxylic Acid Surface Groups", Journal of Materials Chemistry, 2004, 14, pp. 408-412 (5 pages).

Ming-Ye et al. "Polymer Blends of PET-PS Compatibilized by SMA Epoxy Dual Compatiblizers", 1999, 73, pp. 2029-2040 (12 pages).

* cited by examiner

*Primary Examiner* — Alexandra Elve
*Assistant Examiner* — Eyamindae Jallow
(74) *Attorney, Agent, or Firm* — Cox Smith Matthews Incorporated

(57) ABSTRACT

Methods of improving the shelf life of beverages may involve applying a coating mix to a label thereby forming a coated label, curing the coated label, applying the coated label to a container, and adding a beverage to the container, wherein the coated label increases a gas barrier property of the container. Beverage containers such as PET containers may be tailored for specific beverages using certain coated labels.

12 Claims, 6 Drawing Sheets

BEVERAGE CONTAINERS HAVING COATED LABELS WITH MODIFIED GAS BARRIER PROPERTIES AND RELATED METHODS

FIELD

This application relates generally to coated labels for beverage containers with improved gas barrier properties for improving the shelf life of beverages and related methods of producing such labels and containers.

BACKGROUND

Containers commonly used to package beverages include, for example, polyethylene terephthalate (PET). Those containers, of which PET is one example, may have a number of desirable characteristics, including excellent durability, natural clarity, and low cost. Among drawbacks of some of those containers are that they may not be completely impermeable to some gases, such as oxygen and carbon dioxide, for example. For carbonated beverages, this can be particularly problematic, and the shelf life of those beverages may be limited when those beverages are packaged in such containers. After some period, carbonated beverages may develop a taste that lacks their characteristic fizz and may be considered flat by consumers. The shelf life of beverages may also be dependent upon other gases and may, for example, be related to the ingress of oxygen. Oxidation of materials is important to control in a number of beverages, including juice and beer, among others. In part for those reasons, more expensive containers such as glass or specialty copolymers may be used in containers for some beverages.

In view of those difficulties, a number of strategies have been developed to try to increase the gas barrier properties of containers such as PET. Strategies have been developed that modify the polymers of containers, and a number of copolymers have been developed that have improved gas barrier properties. Unfortunately, such strategies may be expensive, may adversely modify other positive attributes of PET containers, and may complicate the organization of beverage production lines. There is, therefore, a need for strategies to improve the gas barrier properties of PET containers, methods that achieve such improvement in a cost effective manner, and methods that may be readily adopted in a beverage bottling facility.

SUMMARY

Methods of improving the shelf life of a beverage are described. Those methods may involve the application of a coating mix to a label and the formation of a coated label. In some embodiments, a carbonated beverage may be packaged in a container that includes a coated label, and the addition of such coated label may improve the shelf life of that beverage by about 10% to about 400%.

Coated labels are described that involve the application of a coating mix to either or both of the outside and the underside of a label. In some embodiments, dual coated labels may comprise different coatings on its underside and outside, and those coatings may be designed as barriers to different gases. The design of coated labels may be useful for a bottling production line that is dedicated for a single product or may be useful for a bottling production line that may be used for various products.

Methods of coating a label to increase the gas barrier properties of the label are described. Those methods may involve the application of a coating to a label using various techniques, including by way of nonlimiting example chemical vapor deposition, plasma enhanced chemical vapor deposition, dipping, and spray coating. Those coated labels may have improved gas barrier properties. Reagents used to form a coating on a label may include, for example and without limitation, epoxyamines, carbon-based species, silicon oxide species, and other species.

Packaging material for various products is described. Packaging material may comprise a container, which may for example and without limitation be comprised of PET walls, and a coated label. Packaging strategies for different products may, in some embodiments, use the same container, or containers made with a similar material or similar structural properties, and may tailor solutions to the different gas barrier concerns for those products using coated labels designed for those particular products.

DETAILED DESCRIPTION

Figure 1:
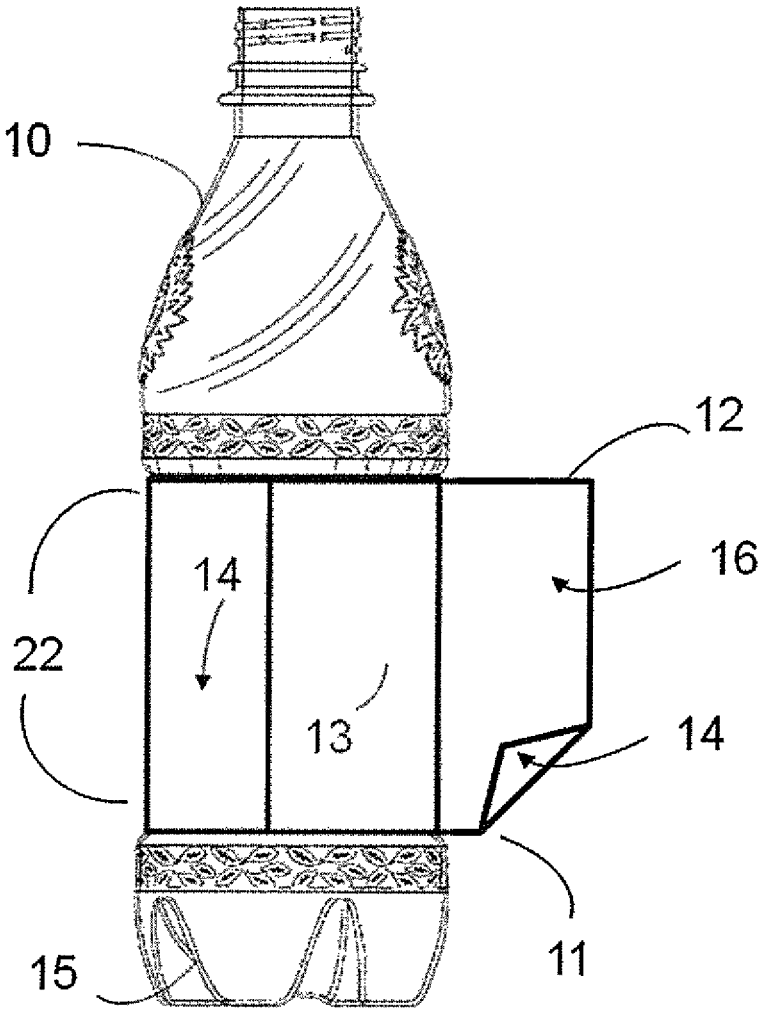
FIG. 1 is a side view of a bottle with a label slightly peeled away from a central portion of the bottle to show surfaces of the label.

The following terms as used herein should be understood to have the indicated meanings.

When an item is introduced by "a" or "an," it should be understood to mean one or more of that item.

The term "application coating bias" as used herein means any metric that reflects the change in thickness of a coating on a coated label between an initial thickness of that coating immediately before application of that coated label to a container and a final thickness of that coating after application of that coated label to that container.

The term "application of coating mix" as used herein means providing at least one reagent from a coating mix to a surface of something.

The term "beverage" as used herein means any drinkable liquid or semi-liquid, including for example flavored water, soft drinks, fruit drinks, coffee-based drinks, tea-based drinks, juice-based drinks, milk-based drinks, gel drinks, carbonated or non-carbonated drinks, alcoholic or non-alcoholic drinks.

The term "beverage packaging" means any material that may be used to enclose a beverage, including by way of nonlimiting example bottles, containers, labels, and caps.

The term "coating mix" as used herein means material comprised from one or more reagents that may be used to form a coating. Coating mix may be homogeneous or heterogeneous, and the one or more reagents of a coating mix may be in a solid phase, liquid phase, gas phase, plasma phase, or a combination thereof. A coating mix may include one or more than one phase and may, by way of nonlimiting example, be a dispersion, heterogeneous liquid, or homogenous liquid.

"Comprises" means includes but is not limited to.

"Comprising" means including but not limited to.

The term "co-polymer" as used herein means a combination of two or more materials that may be polymerized and that may be blended together.

The term "dual side coated label" as used herein means a label that has a coating on both its underside and its outside.

The term "frangible" as used herein means a region that tends to break apart upon application of a force.

"Having" means including but not limited to.

The term "immiscible polymer blend" as used herein means a combination of two or more materials that may be polymerized and which are combined under conditions wherein the two or more materials maintain distinct domains.

The term "including" means including but not limited to.

The term "label" as used herein means a wrapping or other material that may be placed on a surface of a container. A label may provide protection for a container and may provide a surface upon which text, pictorial elements, or both may be placed. A label may be made from paper, plastic, or other materials. In some embodiments, a label may be a shrink-wrap material.

The term "nonpolar" as used herein means having little dipole moment as measured in units of debyes (D). A nonpolar molecule includes any molecule with a dipole moment less than about 0.5 D.

The term "outside" as used herein with respect to a label means the side of a label that may face an exterior environment.

The term "outside coated label" as used herein means a label that has a coating on its outside.

The term "polar" as used herein means having a substantial dipole moment as measured in units of debyes (D). A polar molecule includes any molecule with a dipole moment greater than about 1.0 D.

The term "pre-derivatization" as used herein means treatment of a surface prior to application of a coating to that surface. Pre-derivatization may involve one or more reactions that control the concentration of chemically reactive groups, including but not limited to amines or hydroxyls.

The term "resin blend" as used herein means a resin comprising two or more materials which may be molded or shaped in some way.

The term "spool" as used herein means a portion of a machine that may hold a label.

The term "storage spool" as used herein means a portion of a machine that may hold a coated label.

The term "underside" as used herein with respect to a label means the side of a label that may contact a container.

The term "underside coated label" as used herein means a label that has a coating on its underside.

This disclosure is directed to methods of improving the shelf life of beverages, methods of coating labels to improve their gas barrier properties, and labels and beverages produced using those methods. The shelf life of a beverage may be affected by various factors including, for example, the transport of gases though walls of a beverage container. Gases that may affect the shelf life of a beverage include, by way of nonlimiting example, carbon dioxide, oxygen, and water vapor. Beverage containment strategies may involve various ways to control the transport of those or other gases. The gas barrier properties of containers may, for example, be modified by application of different coatings to those containers, by changing the container walls themselves, or by using other techniques. Those container walls may be manufactured from resin blends which may, for example and without limitation, include a polymeric material such as PET and other materials such as poly (ethylene napthalate), poly vinyl alcohol, or polyamide materials, such as nylon.

Containers manufactured with various coatings or with different wall materials may improve the gas barrier properties of a container. However, the manufacture of those containers as part of the beverage production filling process may complicate a bottling production line. If manufacture of containers and filling of bottles is organized together in a production line, the throughput of those processes should be correlated. Logistical considerations concerning the correlation of those processes together on the same bottling line may be particularly severe when specialty resin blends are used for container walls, and such considerations may prohibit the use of those strategies. Alternatively, containers with various coatings or with different wall materials may be purchased and stored for use on a bottling line. However, the use of multiple different bottles on a production line may not be ideal, may complicate storage and distribution chains, and may also create other problems. Storage space is an important concern for any bottling production line, and keeping multiple different varieties of pre-manufactured bottles on site or near a bottling production line may be inefficient and costly.

The cost of storage of pre-manufactured bottles is not the only issue associated with strategies for controlling gas transport using coated containers or containers whose walls are manufactured from resin blends. For example, the walls of various containers with different coatings, or containers made from different resin blends, will generally have different physical properties and may be handled differently by automated machinery in a bottling production line. This may be a significant concern for some bottling facilities, including, for example, those where a range of different products may be run through the same, or at least some common, handling operations. For those bottling facilities, modification or adjustment of handling systems, such as to optimize those lines for different bottles, may be time consuming and costly. Use of the same type of bottle for different products may minimize this concern; however, those products may have different gas barrier constraints, and such a solution may be less than ideal.

It is possible to coat a bottle at some late stage in a handling process, and doing so may avoid some of the aforementioned difficulties. However, coating a bottle on a filling line at such a process step is an additional complication and adds both cost and time to the overall operation. In addition, such a process step may limit the selection of coating reagents or solvents that may be used in a practical system. For example, some curing operations may be desirable after application of a coating mix, and those operations may, for example, release volatile reaction products, release solvent due to evaporation, or both. A curing step and the release of different chemicals may be time sensitive. If solvent or other species are not allowed sufficient time to evaporate, the risk of contamination of a food or beverage may increase. Additional concerns may exist if, for example, uncured material drips or transfers to unexpected portions of bottling machinery, thereby increasing risk that such material may harden and possibly damage expensive bottle handling machinery. At least for those reasons, coating a container during a bottling operation may negatively impact the timing of those operations and the operation of the machinery that involves the handling of bottles. Additionally, if a bottle is coated, for example, by dipping that bottle in a tank with a coating mix, it may be difficult to cover all areas of that bottle in an optimal way. A bottle may have surface features or curves that affect the flow of material. Excess coating that is applied to a bottle may collect around curved surfaces, and may thin or even fail to cover other areas. In general, the uniformity of coating a substantially two-dimensional object, such as a label as described herein, is improved over objects with more complex geometries.

An improved method of controlling the gas barrier properties of a container may involve coating a label with reagents that modify the gas barrier properties of that label, and upon application of that coated label to a container, it may improve the gas barrier properties of that container. Addition of a coating mix to a label greatly simplifies strategies for optimizing gas barrier containment for beverages. By way of nonlimiting example, machinery associated with coating a label may be substantially partitioned or isolated from machinery that handles bottles. There is generally a significant difference in cost between bottling machinery and labeling machinery, and labeling machinery may be easier to modify. In addition, in some embodiments, a label may be coated well before its application on a high-speed beverage line. Labels are substantially two-dimensional objects, and the space requirements and storage costs of such objects are much less than for bottles. Storage of labels may, for example, be accomplished by winding labels on a spool or other device, or labels may be stored as sheets or in some other manner.

In some embodiments, a beverage may be packaged on a bottling production line, and packaging may, for example and without limitation, include relatively inexpensive, mechanically strong, dent-resistant, and fracture-resistant containers such as PET or some other desirable container. Desirable containers may have beneficial handling properties, and a bottling line may be optimized for handling those or similar containers. At some stage in a packaging process, a beverage label may be coated, that coating may modify the label's gas barrier properties, and that coated label may be attached at some time to that desirable container.

The properties of a coated label may be optimized independently of the properties of the walls of a container. This optimization is in contrast to at least some bottles that are formed from resin blends. Those resin blends may under some conditions be immiscible polymer blends, and may, for example, be fashioned into container walls that are co-polymers with a substantially lamellar structure. A substantially lamellar structure may improve the gas barrier properties of container walls because, for example, a gas may have to pass through distinct polymer domains in passing across the container walls. However, such a structure may compromise the physical properties of container walls that may be made from such co-polymers. Therefore, and irrespective of other advantages, packaging a beverage in a bottling production line may be ideally suited to methods described herein, including, for example and without limitation, some embodiments in which a beverage is added to a desirable container, selected for reasons including but not limited to its physical properties, and modification of gas barrier properties of that container may be achieved through the application of a coated label. By way of nonlimiting example, such an advantage may be achieved using a PET container and application of an epoxyamine coated label.

There may also be important advantages for using coated labels in the packaging of more than one beverage in a single production line. For example and without limitation, two or more beverage products may be packaged on one bottling production line, and those beverage products may have different tolerances for gas permeation. One beverage may, for example, be a carbonated beverage that is highly susceptible to taste degradation upon carbon dioxide egress. Another beverage may, for example, be a fruit juice that is less susceptible to carbon dioxide egress but is highly susceptible to the ingress of oxygen. Those beverages may be packaged on the same production line or on a line that shares some common machinery. Common machinery may perform various tasks including, for example and without limitation, cleaning a bottle, moving or transporting a bottle, loading or unloading a bottle such as to or from a pallet, applying a cap, carrier, label or other structure, filling a bottle, performing a diagnostic measurement on a bottle, or performing some other function. Common machinery may include, for example and without limitation, robotic handlers, palletizers, depalletizers, conveyor belts, tanks, spray nozzles, rollers or other machinery. Common machinery may contact or hold a bottle in various ways, including for example and without limitation, application of pressure to grip or hold a bottle surface such as by friction, by application of a suction, or by using some other method. The optimization of gas barrier properties for those beverages with different gas barrier concerns may be achieved by starting with the same or similar bottles and changing them at a stage that includes application of a label. The ability to change the gas permeability properties of more than one product on one line by changing labels may, for example, greatly simplify ordering and procurement operations in a complicated bottling facility. As noted above, it is easier and less expensive to store reserve coated labels, or reagents useful for coating a label, at a bottling plant than different variations of bottles.

Figure 2:
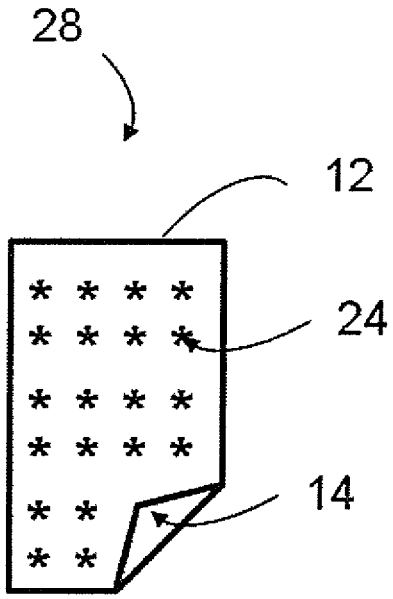
FIG. 2 is a plan view of a label with a coating applied to the underside surface of the label.
Figure 3:
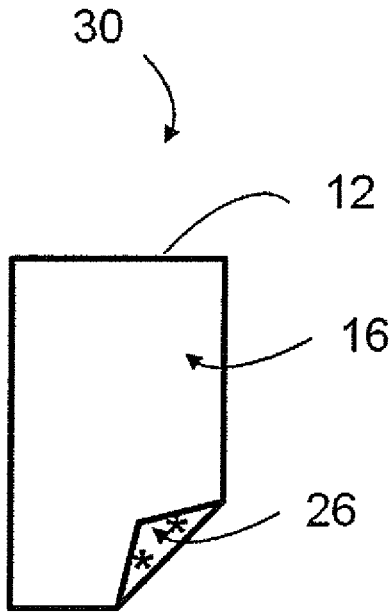
FIG. 3 is a plan view of a label with a coating applied to the outside surface of the label.
Figure 4:
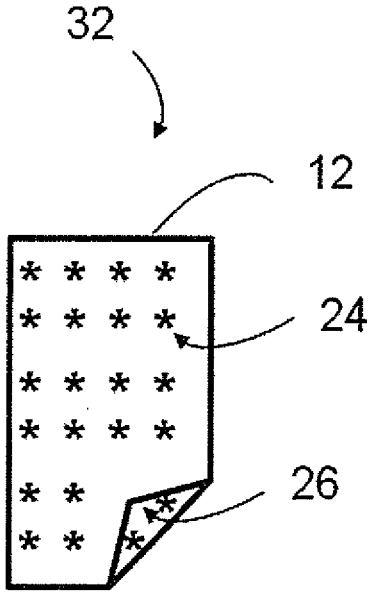
FIG. 4 is a plan view of a label with a coating applied to both the underside surface and the outside surface of the label.

Referring to FIG. 1 of the drawings, the reference numeral 10 designates one of any number of possible containers having a label 12 placed on that container 10. For clarity, and to facilitate discussion of the orientation of various surfaces, label 12 is shown partially peeled away from a central portion 22 of container 10, and a corner region 11 of label 12 is shown in a folded position from that portion of the label that is peeled away. Central portion 22, or any other portion of container 10, or the complete outside of container 10, may be covered partially or completely by one or more labels 12. Those labels 12 may be coated in various ways, including for example as shown in FIGS. 2-4 below, or in other ways. Container 10 may include one or more minimally curved regions, such as region 13, and may contain one or more substantially curved regions, such as region 15. In some embodiments, the modification of a label may be accomplished by coating that label on the underside 16 of that label, on the outside 14 of that label, or on both sides 14, 16. In some embodiments, a label, which may for example and without limitation be a shrink wrap label, may have a coating applied in such a way that the thickness applied at a relatively minimally curved region 13 is different from that at a substantially curved region 15.

FIGS. 2-4 show labels with different coating orientations. The orientation of a label may be described by how it is oriented on a container, and the intended orientation of labels as schematically illustrated in FIGS. 2-4 is similar to the orientation illustrated in FIG. 1. More generally, some labels may have an intended orientation irrespective of whether or not they are oriented on a container. For example, a surface such as an outside surface may have a pattern printed on it that is intended to be seen by a consumer. Similarly, a surface of a label, such as an inside surface, may have an adhesive or some other characteristic that facilitates attachment of the label to a container. Possible orientations of coatings on a label include those illustrated by underside coated label 28 (FIG. 2), outside coated label 30 (FIG. 3), and dual side coated label 32 (FIG. 4). Underside coated label 28 has a first coating 24 on the underside of the label, outside coated label 30 has a second coating 26 on the outside of the label, and dual side coated label 32 has a first coating 24 on one side and a second coating 26 on another side. First coating 24 and second coating 26 may be applied to label 32 at the same or different times, and coatings 24 and 26 may be the same or different. Some embodiments may take advantage of the concept that a dual side coated label 32 may have different coatings 24, 26 on its two sides.

Some coatings may, for example, be designed for controlling the transport of species that may be polar, but may not simultaneously provide an adequate barrier to nonpolar species. By way of nonlimiting example, some epoxyamine coatings have substantial capability for hydrogen bonding and may function as very good barriers to polar molecules. By way of nonlimiting example, some carbon-rich coatings or silicon-rich coatings may be a substantial barrier to nonpolar molecules. By way of nonlimiting example, oxygen is a nonpolar species that does not have a significant dipole moment, whereas water has a substantial dipole moment and is a polar molecule. Some coatings may, for example, be designed for controlling the transport of a species that may be nonpolar, but may not provide a good barrier to polar species. Combination of some reagents with the aforementioned properties may be complicated, for example, because those reagents may have differences in polarity and may segregate into domains that are not desired. If those reagents are used in some procedures with dual side coated labels 32, the processing of those reagents may be simplified. In some embodiments, it may be a challenge to combine coatings with different polarities using other strategies that do not involve dual side coated labels 32.

As noted above, first coating 24 and second coating 26 may be different. In some embodiments, one of those coatings may be an epoxyamine and one of those coatings may be a carbon-rich or silicon-rich coating. In some embodiments, one coating may be derived from a coating mix that is applied using chemical vapor deposition or plasma enhanced vapor deposition, and another coating may comprise an epoxyamine that may be deposited from a coating mix in a tank, such as by dipping a label in that tank, or may be sprayed on a label. In some embodiments, dual side coated label 32 may comprise a first coating 24 that may be designed to improve the barrier properties with respect to one type of gas, and second coating 26 may be designed to improve the barrier properties with respect to a different type of gas. In some embodiments, dual coated label 32 may comprise a first coating 24 and a second coating 26, either or both of which may be polymers that are not compatible together in a resin blend or that do not conveniently form layers that are substantially lamellar. By way of nonlimiting example, polymers may be incompatible in a resin blend if they experience an unwanted side reaction when combined, if during steps such as curing they form discrete domains that are not lamellar, if they cure with substantial defects or pinholes, or combinations thereof.

Labels may be coated and may be applied to containers of various shapes, sizes, and types, including beverage bottles, for example. Any of various types of labels may be coated, including, for example and without limitation, shrink-sleeve labels, pressure sensitive labels, adhesive labels, and other types of labels. In some embodiments, a label may be made from material that is designed to change shape upon the application of heat and may, for example, be a shrink-wrap label. A shrink-wrap label may be applied to a container in a manner that is loose. Upon application of heat, a shrink-wrap label may change shape and may more tightly fit around that container. Referring back to FIG. 1, a substantially curved region 15 may experience a more significant change in shape than other areas, such as a minimally curved region 13. The thickness of a label, which may be for example and without limitation a shrink-wrap label, and the thickness of a coating on that label may be affected by the degree of shape change such label is designed to undergo. The thickness of a coating on a label may be applied uniformly across a label surface, or a coating may be non-uniform. In some embodiments, the thickness of a coating applied to a label may be designed to, at least in part, counteract changes in thickness that may occur upon application of that coating to a container. In some embodiments that involve the purposeful application of coating in a non-uniform way, the position on a label upon which a coating mix is applied may be oriented such that a position on a label is correlated with its eventual position as applied to a container. The orientation of a coating mix on a label may be accomplished in various ways, including, for example, the use of precut labels, or applying a label from a roll of material that may be partitioned in some way, such as by having a perforated or an otherwise frangible surface designed at some portion of that label.

Various ways may be used to determine the thickness of a coating at a stage after that coating may be applied to a label, and also to determine the thickness of that coating after it is applied to a container. Measurements of coating thickness may, for example and without limitation, take advantage of differences in refractive index between various materials, such as the refractive index of a label, the refractive index of a coating, the refractive index of an adhesive, and the refractive index of the walls of a container. Optical measurements that rely on refractive index may include, for example, techniques that rely on polarization of light such as ellipsometry, which may be useful for various reasons. For example, such techniques may be useful because they may be rapid, non-destructive, and may have high spatial resolution. Some attributes of such measurement techniques, for example, including but not limited to some optical methods described above, may be beneficial for diagnostic measurements that may be used to monitor a production line.

Using thickness measurement techniques, including but not limited to those above, an application coating bias may be determined. The determination of an application coating bias may be important for some coatings including, for example, those that are thin. In some embodiments, the determination of an application coating bias may not be necessary. A thin coating may be used for various reasons. By way of nonlimiting example, reasons for use of a thin coating may include that a thin coating may minimize reagent cost, control the formation of defects or pinholes due to reasons including for example thermal stress, provide optical clarity, affect how readily a coated label may peel from a container, any combination thereof, or other reasons. Thicker coatings may be useful in some applications because a thicker coating may provide better barrier protection, may minimize variability due to differences in a coating thickness of a coated label, or may be desirable for some other reason. The determination of an application coating bias may be determined from thickness measurements at a point on a coated label that is applied to a container or may be based on more than one point. An application bias that is determined from more than one point may be a representative value for a bottle including, for example and without limitation, an average value or median value. An application bias that is determined form more than one point may be representative of different positions on a coated label that is applied to a container, and may be reflective of values at different points on a bottle.

In some embodiments, the thickness of a coating may be measured at one or more stages in the production of coated labels that may be applied to containers and that may be used in a gas containment strategy for a beverage. Such measurements may be used in quality control techniques to monitor a bottling production line.

In some embodiments, an epoxyamine coating may be applied to a label, and that label may be applied to a PET container in a shrink wrap process. That container may be used to hold a carbonated beverage that has a shelf life that may, for example, be limited by the loss of carbon dioxide. For some carbonated beverages, significant taste degradation may occur if the loss of carbonation is between about 15% and about 20%, and without other containment strategies the shelf life of such beverages in some PET containers may be less than about 10 weeks. Use of an epoxyamine coated label applied as a shrink wrap to a PET container may be expected in some embodiments to improve the barrier properties of beverage packaging by an amount from about 10% to about 400%. Those improvements may, in some embodiments, improve the shelf life of a carbonated beverage to a period from about 11 weeks to about 50 weeks.

Expectations in shelf life improvement may, for example and without limitation, be based on the barrier properties of a material that may be used as a coating, the thickness of the coating applied, and the fraction of a container that is covered by a coated label. Use of thicker coatings may improve the barrier properties of beverage packaging material; however, such may also increase the cost of packaging material. The barrier properties of a number of materials are known, including, for example, because those materials have been used as coatings on containers. The use of some materials that have been used to coat bottles may be used to coat a label. The barrier properties of a surface, film, or bottle may be measured in various ways using standard testing procedures. Permeation rates may, for example, be measured by placing a bottle into a sealed chamber and measuring the amount of a gas that enters that chamber as a function of time. Such measurements may, for example, be taken using a MOCON Permatran-C Model 10 testing system, which is a trademark of Modern Controls Inc. Near room temperature, the permeation rate of carbon dioxide from various containers may range from between about 2 cc/day to about 15 cc/day. Carbonated beverages in different containers may have different volumes, different surface areas, or both, and may lose more or less carbon dioxide, depending, for example, on those or other factors. Application of different coated labels may improve the permeation rate of containers, and for some containers with some coated labels a carbon dioxide loss of less than 1 cc/day may be expected.

Labels may be dispensed from various labeling machines, and those machines may use labels that may or may not have been precut. Labeling machines may hold a label in a spool, reel, or other device before application to a container. In some embodiments, labels may be coated before they are loaded on a machine on a bottling production line. In some embodiments, coating a label may involve transfer of a label from one or more spools through coating operations and then to one or more storage spools. A storage spool may include a mechanism for winding a coated label and holding a coated label in such a way that for at least part of a storage period, a coated surface in one winding around a spool does not substantially contact an adjacent surface on a next winding of the storage spool. A small gap between adjacent windings on a storage spool may, for example and without limitation, be maintained using a spacer element that may contact a label on, for example and without limitation, it's edge. In some embodiments, a spacer material may be wound along with a coated label, and the coated surface may, for example, when wound on a spool, be in contact with that spacer material. That spacer material may prevent or limit the contact of a coated label with other portions of a coated label on that storage spool. Such a spacer may contact a coated label on more than an edge of that coated label and may serve a protective role or other role for a coating. A spacer may be made from various materials including, by way of nonlimiting example, plastic or paper, and the spacer material may or may not be recycled or reused. While stored on a storage spool, a coated label may be under various conditions of pressure, temperature, humidity, or other conditions, and those conditions may, in some embodiments, be adjusted to help control the curing of a coating layer. In some embodiments, a label may be dispensed from one spool on a machine located on or near a production line, may be coated, and then stored on a storage spool prior to application on a container. In some embodiments, a label may be dispensed from one spool on a machine located on or near a production line, may be coated, and then applied directly to a container.

Reagents used to form a coating on a label may, for example and without limitation, comprise epoxyamines, carbon-based species, silicon oxide species, or other species. Reagents used to form a coating may provide improved barrier properties, facilitate adhesion, enhance strength, or any combination thereof. Epoxyamines may contain one or more amine groups and one or more epoxide groups. Epoxyamine reagents may include for example Bairocade™ which is a trademark of PPG, or other epoxyamines. Epoxyamine reagents may be derived from starting substrates including, for example but not limited to, bisphenol A (2,2'-bis(4-hydroxyphenyl) propanol commonly referred to as BPA, and may be processed in various ways to encourage cross linking of the material. In some embodiments, epoxyamines may be formed from two or more reagents that include at least one epoxy resin and at least one epoxy hardener. In some embodiments, silicon, carbon, or a combination of both may be deposited on a label by application from a coating mix that may, for example and without limitation, comprise reagents in the gas or plasma states. Some embodiments may involve using silane reagents, organosilane reagents, or a combination of both. A silane or organosilane reagent may include one or more functional groups that may be substantially lost in processing of a film, including, for example and without limitation, chlorine atoms or other halogens. In some embodiments, silicon-rich or carbon-rich films may incorporate some amount of other atoms, including, for example, nitrogen or other species that may affect film density and/or barrier properties. The ratio of silane and organosilane ratios may be controlled to produce coatings of various carbon contents or various silicon-to-oxygen stoichiometries. Silicon oxide-based films may include organic moieties, may be substantially amorphous, or may have various degrees of crystallinity. Any number of variables that control the properties of a film deposited using plasma-enhanced deposition may be used to coat a label. Such variables may, for example and without limitation, include the pressure of gas molecules, concentration of ions in a plasma, temperature of ions or electrons, properties associated with electric potentials of electrodes, or any combination thereof.

In some nonlimiting embodiments, formation of a coating that is rich in carbon, rich in silicon, or both may involve the use of chemical vapor deposition (CVD) or low temperature plasma deposition techniques. In some embodiments, application of a coating mix may involve dipping a label into a coating mix that is a dispersion, such dispersion comprising an epoxyamine, and may be followed by curing and drying the coating material derived from the coating mix. Application of coating mix to a label may, in some embodiments, involve dipping, spraying or flowing coating mix over a label. In some embodiments, a label may be repetitively dipped into a coating mix that comprises a dispersion, and coating material may be added to the label each time that label is dipped. In some embodiments, a coated label may be dipped into a coating mix that comprises a dispersion in order to fill in voids or defects that may exist in the coating of that label.

A material used in a coating mix may be diluted in a solvent. In some embodiments, a coating mix may be applied to a label as a spray. A solvent in which a coating mix is diluted may control the viscosity of the coating mix and may facilitate the application of a uniform spray. A coating mix may be applied through a spray and may be applied under pressure using one or more nozzles, and those nozzles may be in any configuration or number. In some embodiments, a spray may be applied while holding the tip of a nozzle at an electric potential, and may use any of various techniques associated with electrospray.

In some embodiments, a method for coating a label may comprise dipping a label into a coating mix contained within a tank, that coating mix comprising an aqueous dispersion of a reagent that may form a coating, withdrawing the label from a tank at a sufficient rate to facilitate the formation of a substantially intact coating comprised of that reagent, and drying the coating. That tank may, in some embodiments, be stirred or include a dispersion of a reagent that is flowing. Drying that coating may, in some embodiments, include flowing air past a label, and the rate of drying may, in some cases, involve application of heat, light, or a combination of heat and light.

A tank and other machinery may be configured in various ways. As described for example in relation to FIG. 8, machinery may be placed between a spool and a storage spool. More generally, a tank may hold a coating mix, cleaning liquid, or other materials, and may be located between a spool and a storage spool, between a spool and a portion of a bottling production line, or in some other arrangement.

In some embodiments, a coating mix may be applied to a label, and that coating mix may comprise one or more reagents that may serve as a gas barrier and may also facilitate adhesion. In some embodiments, the same reagent in a coating mix that affords increased barrier protection may also function to enable adhesion. Coating materials that may function both to improve barrier protection and to enable adhesion include, for example and without limitation, some epoxyamines. In some embodiments, one or more reagents may be added to enhance the barrier properties of a label, and one or more different reagents may be added that enable adhesion. Adhesion may involve providing integral and stable contact between a coating material and a label, may involve providing integral and stable contact between a coating material and a container, or both. An adhesive reagent may, in some embodiments, bond chemically with the walls of a container or label, and that chemical bond may be, for example and without limitation, a covalent bond. Adhesion between a coating and a surface may involve chemical reaction between a surface group on a label or a container. In some embodiments, that surface group may be, for example and without limitation, an amine or a hydroxyl. The concentration of surface groups may be controlled by treatment of the surface prior to addition of a coating mix. Treatment of a surface prior to application of a coating mix may involve placing that surface in a controlled humidity environment, addition of one or more chemicals to pre-derivatize the surface, modification of surface roughness, involve other treatments, or any combinations thereof.

One or more solvents may be used that enable mixing of an adhesive material and a material useful for a coating. In some embodiments, a scavenger molecule may be added to a coating or coating mix, and that scavenger may react with and bind a component including, by way of nonlimiting example, oxygen.

In some embodiments, a coating mix may be applied as a thin layer and added in a repetitive manner to build up a coating. Thin layers may be useful for coatings that are applied using any of various processes including, by way of nonlimiting example, plasma enhanced deposition. The desired thickness of a deposited coating that is applied in a layered process, and that may be used to build a coating in a repetitive manner, may be related to the application of heat and thermal processes which may subject a layer to thermal stress.

In some embodiments including, for example and without limitation, when a relatively high solvent content is used to dilute coating reagents in a coating mix, such as may be important to enhance the uniformity of a spray, the initial thickness of a film applied to a label may be higher than the final desired thickness. Evaporation of solvent or other processes may, for example and without limitation, result in a target application thickness that is up to about 25% different than the desired final thickness, or that difference may be even greater. In some embodiments, the time period following the application of a coating mix to a label may include a controlled change in temperature from a temperature greater than room temperature to about room temperature. That controlled change in temperature may help to control different reactions that occur during the curing of a coating, may help to control thermal stress, such as to minimize the creation of coating pinholes or defects in a coating, or any combination thereof.

Evaporation of solvent or generation of other species during curing reactions may occur from a coating at any time including, for example and without limitation, before or after a label is rolled onto a spool or contacted with a container. The rate of evaporation of solvent or generation of other species from a coated label may be controlled by modification of conditions, including but not limited to temperature and ambient pressure. In some embodiments, it may be valuable to provide a flow of air to increase the transport of generated species away from a coated surface. In some embodiments, an air flow may be provided to a surface that is faced away from a central portion of a storage spool upon which a coated label may be wound. In some embodiments, system variables including, for example, the thickness of coating material applied to a region on a label, the time between application of a coating material and winding a coating on a storage spool, the time between application of a coating mix and application to a container, solvent content, temperature, other variables, or any combination thereof, may be used to modify the final thickness of a coated label. When solvent or other species are generated or released from a film during curing stages, the transport of species from a coating may be related to access to the external environment. For example and without limitation, solvent that evaporates from a coating that is thick may have a difficult time diffusing through the entire thickness of a coating. The transport of solvent molecules or other species to the exterior environment may involve diffusion of species through the coating or in some cases transport through a label. In that regard, the porosity of the label or other characteristics may be controlled to modify the transport of evaporated solvent or other species from a coating. In some embodiments, a label may be porous, or may be selected because of another characteristic, such that the transport of evaporated solvent used with a coating may be controlled. In that light, the control of porosity of a label or selection of a solvent that is compatible with a label may be used to modify the properties of a coating.

A coating mix may be applied at the same or different thickness at different regions of a label. It is noted that for a coating the ability to serve as a gas barrier may be related to the thickness of that coating. In general, for a structurally intact coating, the barrier properties of that coating will depend on the thickness and may increase with thickness. The relationship between thickness of a coating and gas barrier characteristics of a coating may not hold if a coating becomes cracked or physically compromised. For some coatings, the probability that the coating may crack or may become physically separated from a container due to a shear force or bending moment may increase or decrease with thickness. In light of this, in some embodiments, a coating mix may be added to a label in a manner such that areas of the label that may be in contact with regions of a bottle that may be under high stress or areas where a label may be subjected to a shear force or bending moment may be thinner or thicker than areas of a bottle that experience low stress. Areas of a bottle that may be under greater stress during production may, by way of nonlimiting example, be related to the curvature of bottles, may be related to the stacking of bottles in cases, may be related to the degree by which a shrink film changes shape during application, or may be related to other factors. One or more forces or moments that a bottle may be subjected to during processing may be measured, for example, by the use of force and moment sensors in a package, and data from force and moment sensors may be correlated to a physical stress, such as a shearing stress or bending moment that a bottle with a coated label is subjected to. In some embodiments, the thickness of a coating on a label may be correlated with force and/or moment data and optimized for a given product, for example, by maximizing the film thickness in regions of low physical stress and minimizing the film thickness in regions of high physical stress, or vice versa. In some embodiments, the thickness of a coating on a label, that may for example and without limitation be applied in a shrink wrapping process, may be related to the degree by which that coating is stretched during application.

The application of a coating mix that is of nonuniform thickness may be accomplished in various ways. A nonuniform coating mix may be applied, for example and without limitation, by controlling the flow of materials through one or more spray nozzles, the relative distance of one or more nozzles from a label, by other methods, or using a combination of techniques. The thickness of a coating mix applied to a region of a label may be optimized to provide improved barrier properties, may be optimized to provide adherence between the label and a container, or both. In some embodiments, the thickness of a coating mix or the amount of coating material applied to the label may depend upon the surface texture of a bottle.

Figure 5:
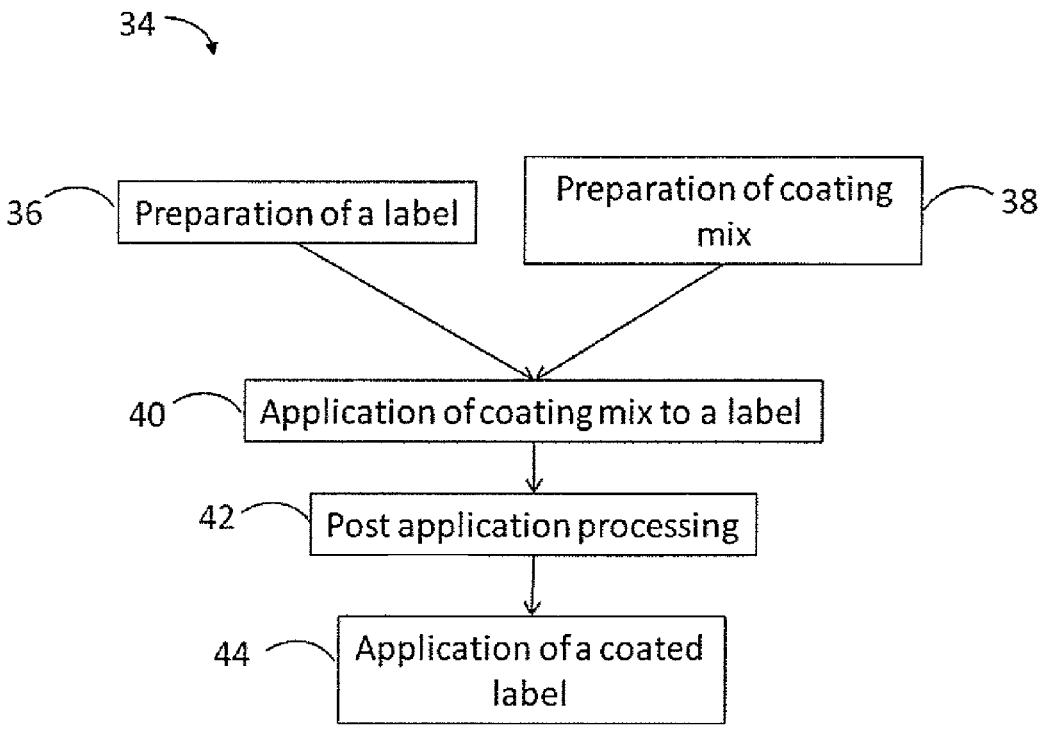
FIG. 5 is a flowchart showing a method of coating a label and applying that coated label.

Referring to FIG. 5 of the drawings, the reference numeral 34 designates generally methods of coating a label and the application of that coated label to a container. Those methods comprise preparation of a label at step 36, preparation of a coating mix at step 38, application of a coating mix to a label at step 40, post application processing at step 42, and application of a coated label to a container at step 44.

In some embodiments of methods 34, the preparation of a label at step 36 may involve procedures including, for example but not limited to, cleaning the surface of a label, pre-derivatization of a label surface, drying a label, unwinding a label from a spool, cutting a label, or any combination thereof. Cleaning a label may involve application of a cleaning solution to a label, application of a stream of low particulate air, treatment with a supercritical fluid, application of plasma, other processes, or any combination thereof. That label may or may not be pre-cut to a desired final shape. In some embodiments, a label may be cut from a stock material and may be cut to a size that may be the same or different from the desired final shape. Cleaning operations may involve rinsing the label using one or more cleaning liquids. In some embodiments, one or more cleaning liquids may be applied to a label by spraying through one or more nozzles, dipping a label in a tank, or using some other application technique. Spraying a cleaning solution upon a label may be useful because the liquids may be applied using pressure, and in some embodiments spray washing a label may be done immediately before application of a coating mix to a label in step 40. The use of a spray in cleaning a label may be the sole cleaning step or may be a final wash after other cleaning strategies are employed. A filter may be used to minimize particulate matter that may be present in a cleaning liquid. A cleaning liquid may be maintained at room temperature or may be heated. In some embodiments, a label may be dipped in a cleaning liquid that is a warm solution, and that cleaning liquid may be acidic or basic. By way of nonlimiting example, an acidic cleaning solution may be produced by addition of a mineral acid or organic acid to a cleaning solution, and a basic cleaning solution may be produced, by way of nonlimiting example, by addition of a hydroxide salt to water. In some embodiments, one or more peroxides or other reagents that may create sources of reactive oxygen may be added to a cleaning liquid.

Figure 6:
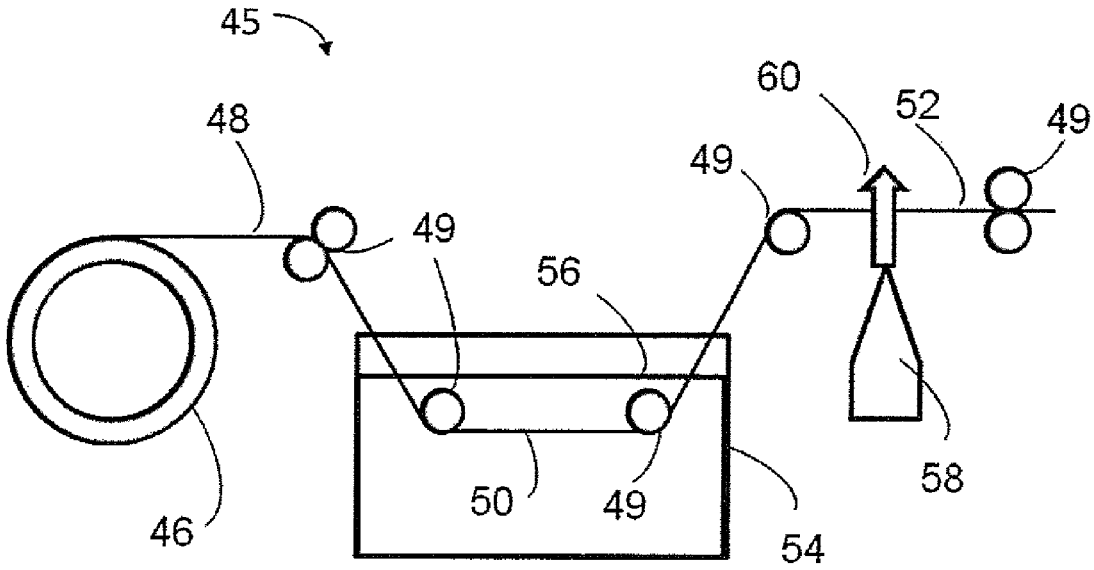
FIG. 6 is a schematic view of a system that may be used to prepare a label for coating.

Referring to FIG. 6 of the drawings, some possible configurations of a system of machinery 45 are shown that may be used to perform step 36 of preparation of a label as described above. In some embodiments, system 45 may comprise a spool 46 that may unwind a roll of label material, that roll of label material comprising a first section of label material 48, a submersed section of label material 50, and an exiting section of label material 52. Label material may be directed along a path by rollers 49 or by some other device that pulls or directs the label material. A submersed section of label material 50 may be located underneath a cleaning liquid 56 contained in a tank 54. An exiting section of label material 52 may be directed across a region that is near an air nozzle 58 or some other device for producing an air stream 60 that is blown onto the label material. The length of submersed section of label material 50 and the residence time in solution of a specific portion of the label material may be adjusted by controlling the length and the rate at which spool 46 may be unwound. While the submersed section of label material 50 is shown, for example, in FIG. 6 to be along a straight line, it may be directed along any path of any shape.

In some embodiments, ultrasonic energy may be applied during a portion of a cleaning process. For example and without limitation, tank 54 may in some embodiments be an ultrasonic bath. In some embodiments, cleaning solution may be added in a single step or in more than one step and may include addition of one or more polar liquids, one or more nonpolar liquids, or both. Cleaning liquids 56 may be an aqueous solution, an organic solution, or a combination of both. Organic solutions may comprise, by way of nonlimiting example, methanol, ethanol, isopropyl alcohol, acetone, or butanol. In some embodiments, an organic solution that is used as a cleaning liquid 56 may be an organic solution with a relatively high vapor pressure. FIG. 6 shows the use of a single tank 54 in a preparation of a label step 36. Such depiction should not be viewed as limiting, and in some embodiments, more than one tank 54 may be used. Additional tanks may, by way of nonlimiting example, be filled with the same or different cleaning liquids, or may be filled with a reagent that pre-derivatizes a label surface.

Referring back to FIG. 5, a preparation of coating mix step 38 may involve combining one or more reagents useful in preparation of coating material. That label may or may not be pre-cut to a desired final shape. As described previously, those reagents may be useful for improving the barrier properties of a coating, useful in facilitating adhesion, improve coating strength, improve other film properties, or any combination thereof. The one or more reagents that may be used to comprise a coating material may be added to one or more tanks prior to application to a label and may be diluted in one or more solvents. Solvents may comprise aqueous solutions, organic solutions or combinations. By way of example and without limitation, solvents that may be used with epoxyamine reagents may comprise tert-butyl acetate, isopropyl bromide, or other solvents. In some embodiments, a first holding tank may comprise a material that may be used as an epoxyamine resin, and a second holding tank may comprise a material that may function as an epoxyamine hardener. The first tank and the second tank may remain separate prior to application to a label, and those tanks may include one or more different solvents. In some embodiments, a reagent that may be, for example and without limitation, an epoxyamine may be added to a tank in the form of a dispersion. In some embodiments, preparation of coating mix step 38 may involve preparing a silicon-rich or carbon-rich reagent for deposition in a plasma enhanced deposition system. Preparation of those reagents may involve, for example and without limitation, the formation of silane or organosilane gases.

Figure 7:
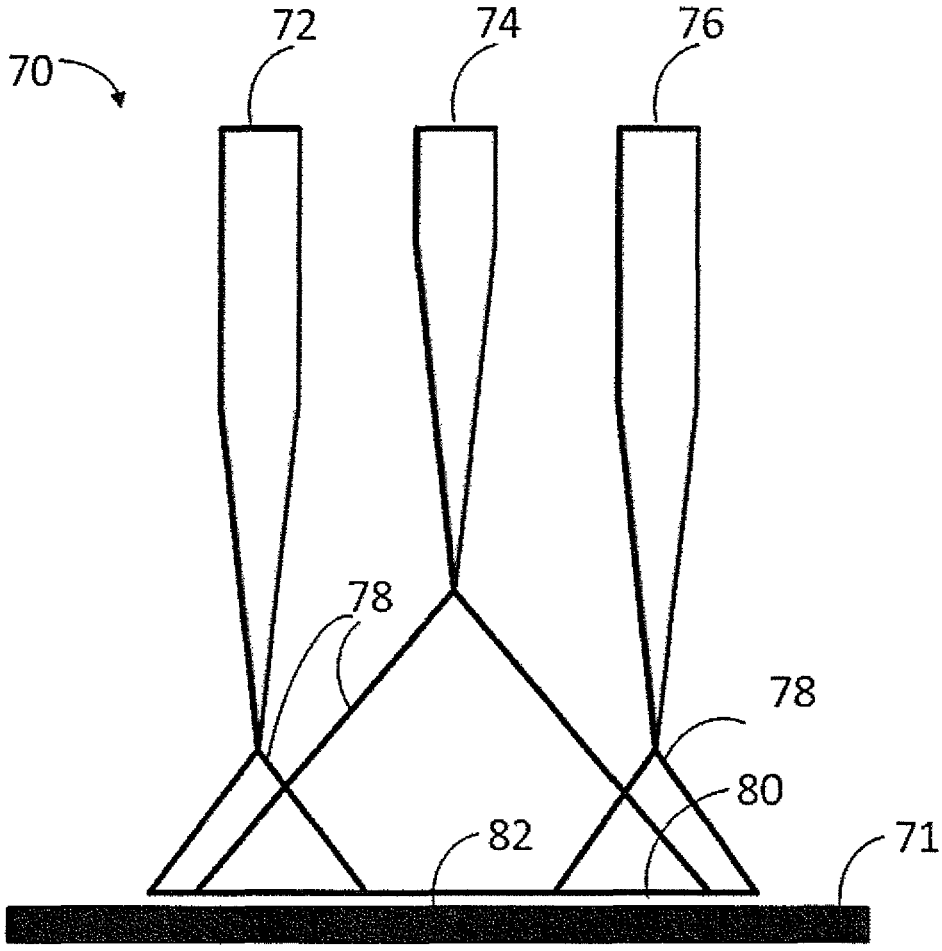
FIG. 7 is a schematic view of nozzles that may be used to apply a coating material to a surface of a label.

Still referring to FIG. 5, application of a coating mix to a label 40 may involve chemical vapor deposition (CVD), low temperature plasma deposition techniques, spraying a coating mix, dipping a label in one or more tanks, or any combination thereof. FIG. 7 shows one nonlimiting example of a configuration of nozzles 70 for spraying one or more reagents 78 onto the surface of a label 71 using nozzles 72, 74, and 76. In FIG. 7, center nozzle 74 is shown to spray reagent 78 onto a label 71 and is shown offset at a different distance from the label surface than edge nozzles 72 and 76. As configured in FIG. 7, a first region 80 of label 71 may intersect reagent spray 78 from more than one nozzle, such as center nozzle 74 and edge nozzle 76, whereas a second region 82 of label 71 may intersect with reagent spray 78 from only the center nozzle 74. Such a configuration may, for example, result in a thicker coating at the first region 80 of label 71 than at the second region 82 of label 71. Of course, it should be understood that the configuration of nozzles shown in FIG. 7 is described for example purposes only, and any number of nozzles, organized in various ways, may be used to control the relative thickness in a given region of a label. In some embodiments, nozzles may be connected to reagents from different tanks and, for example, one nozzle may be connected to a tank that is an epoxyamine resin and another nozzle may be connected to a reagent that is an epoxyamine hardener.

Figure 8:
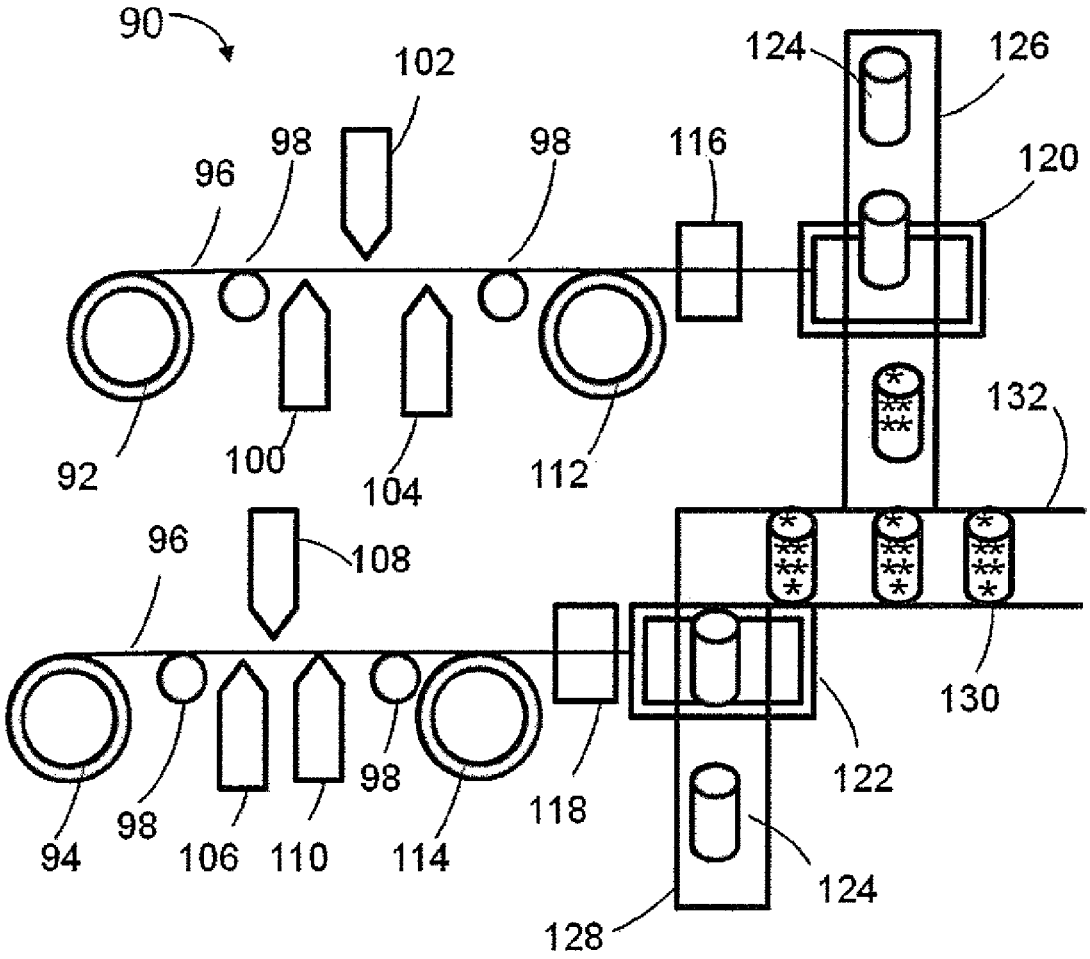
FIG. 8 is a schematic view of a system that may be used to apply a coating mix to a label and apply a label to a container.

In some embodiments, application of a coating mix to a label at step 40 may involve machinery that is not directly associated with a bottling production line. For example, a label may be coated using plasma enhanced deposition or some other technique and then stored for any period of time prior to application of that coated label. In some embodiments, a label may be coated using machinery that is included on or near a bottling production line. Application of a coating mix to a label may involve transfer of label material between spools and storage spools or other devices that conveniently store a label, such as rolled up, in large sheets, or in some other manner. Label material may be cut along any step in a process as necessary. FIG. 8, described in more detail below, illustrates by way of nonlimiting example possible configurations of machinery that may be used for application of a coating mix to a label at step 40, post application processing step 42, and application of a coated label at step 44 (see FIG. 5).

Still referring to FIG. 5, methods 34 may include a post application processing steps 42. Post application processing step 42 may include, by way of nonlimiting example, curing a coated label, printing on one or more sides of a coated label, addition of adhesive to a coated label, storage of a coated label, cutting or perforating a coated label, or any combination thereof. A post application processing step 42 may include a curing stage where the label is allowed to sit for some period of time, and that may or may not involve the application of heat or light. As described above, in some embodiments, a label may be coated and stored for any period of time prior to being used on a bottling production line. A coated label may be stored in various ways including, by way of nonlimiting example, on a storage spool, and a coated label more or may not be stored in a warehouse. Those techniques may be advantageous for various reasons including, by way of nonlimiting example, if the time between application of a coating mix and the hardening or setting of a coating is long, and coating a label before its use on a bottling production line may simplify production logistics.

In some embodiments, the application of a coated label to a container may involve adding adhesive to the coated label or to the container upon which that coated label may be applied. Addition of adhesive in post application processing step 42 may be done after the completion of curing, or before completion of curing. Post application processing step 42 may involve curing an applied coating and may, in some embodiments, benefit from procedures that rapidly cure a coating. Rapid curing of a coating may be accomplished, for example and without limitation, by passing a coated label through a zone where that coated label is heated or where optical energy is applied, application of an air steam, or any combination thereof.

Still referring to FIG. 5, methods 34 may include the application of a coated label step 44. An application of a coated label step 44 may be achieved using, by way of nonlimiting example, shrink wrapping techniques, may use an adhesive, or other techniques. A coated label may be applied to various containers including bottles that may be filled or are intended to be filled with a beverage. Those containers may be PET bottles or may be composed of other materials. In some embodiments, those bottles may be comprised of copolymer walls produced by a copolymer resin or those bottles may themselves be coated. In that regard, the use of coated labels does not preclude the use of other strategies that improve gas barrier properties, and some embodiments described herein anticipate the use of coated labels with other strategies for gas containment, including for example the use of labels that are made from resin blends.

Referring to FIG. 8 of the drawings, and by way of nonlimiting example, possible configurations of a system of machinery 90 that may be used in a portion of a method 34 are illustrated. Portions of methods 34 may include, for example, application of a coating mix to a label step 40, post application processing step 42, and an application of a coated label step 44. FIG. 8 illustrates a first spool 92 and a second spool 94. The first spool 92 and the second spool 94 may unwind material 96 that may be used for a label. First spool 92 may unwind label material 96, which may be directed in various ways, including, for example and without limitation, by rollers 98 past one or more underside nozzles 100. Underside nozzle 100 may spray a reagent useful for a coating on the underside of material 96. Material 96 may then be directed past one or more outside nozzles 102. An outside nozzle 102 may spray a reagent useful for a coating on the outside of material 96. Outside nozzle 102 and underside nozzle 100 may spray the same or different reagents and may, for example, be used to create a dual side coated label 32, as described in relation to FIG. 4. Omission of either outside nozzle 102 or underside nozzle 100 may be used to create either an underside coated label 28, as described in relation to FIG. 2, or an outside coated label 30, as described in relation to FIG. 3. Material 96 may then be directed past a curing element 104 that may function to increase the rate of curing of a reagent. Curing element 104 may provide, by way of non-limiting example, a stream of air, electromagnetic energy such as infrared light, energy in the form of heat, some other source of energy, or any combination thereof. As shown in FIG. 8, material 96 may be directed from both a first spool 92 and a second spool 94. The illustration of those spools (92, 94) is provide by way of example and should not be viewed as limiting. For example, any number of spools, including one or more than one, may be used in some embodiments. In FIG. 8, material 96 derived from second spool 94 is shown to be passing machinery that is similar to that of material 96 that is derived from first spool 92. Material 96 may, for example, be directed to pass a second underside nozzle 106, a second outside nozzle 108, and a second curing element 110. In other embodiments, the configuration of machinery associated with first spool 92 and second spool 94 may be different.

As described in relation to FIG. 8, material 96 may be operationally coupled to either a first storage spool 112 or a second storage spool 114. First storage spool 112 may assist in organizing the passage of material 96 and may, for example, serve to organize the flow of material to other pieces of machinery. In some embodiments, a section of material 96 may be wound on first storage spool 112 and cut. The cutting of material 96 may create one section of material that is not contiguous with other sections of that material 96. Cutting material 96 into sections may allow some portions of material 96 to be directed at a rate that is independent of other sections without ripping or stressing the material 96. In a similar manner, second storage spool 114 may organize the transport of material from second spool 94.

Still referring to FIG. 8, material 96 from first storage spool 112 may be directed past a first printer 116 that may add one or more pictorial and/or text elements to a label. Material 96 from second storage spool 114 may be directed past a second printer 118 that may also add one or more pictorial and/or text elements to a label. Label material may be directed past first printer 116 or second printer 118 to either a first label application unit 120 or a second label application unit 122. Those application units may serve to execute an application of a coated label step 44, as described in relation to FIG. 5. Referring back to FIG. 8, bottles 124 may be directed through either a first section of a production line 126 or a second section of a production line 128. A label may be applied to bottles 124 in either application unit 120 or 122, and labeled bottles 130 may be directed along a third section of a production line 132 and may, for example, be further processed into containers and shipped for sale and distribution, either before or after being filled with a beverage.

While many examples in this disclosure refer to methods of producing modified labels with improved gas barrier properties and to modified labels produced using those methods, it is understood that those methods of producing modified labels with improved gas barrier properties and to modified labels produced using those methods are described in an exemplary manner only and that other methods may be used. Additionally, other reagents may be used, depending on the particular needs. Any of the features described herein may be used in any desired combination. Although the foregoing specific details describe certain embodiments, persons of ordinary skill in the art will recognize that various changes may be made in the details of these embodiments without departing from the spirit and scope of this invention as defined in the appended claims and considering the doctrine of equivalents. Therefore, it should be understood that this invention is not limited to the specific details shown and described herein.

What is claimed is:

1. A method of improving the shelf life of a beverage through modification of the gas barrier properties of beverage packaging, comprising:

applying a coating mix to a label thereby forming a coated label;

wherein said applying a coating mix to a label is performed after said coated label is added to a labeling unit on a bottling production line;

curing said coated label;

applying said coated label to a container; and adding a beverage to said container;

wherein said coated label increases a gas barrier property of said container.

2. The method of claim 1 wherein said applying said coating mix comprises dipping said label in a tank, spraying from one or more nozzles, or a combination thereof.

3. The method of claim 1 wherein said applying said coating mix comprises deposition of a reagent from a gaseous phase.

4. The method of claim 3 wherein said deposition of a reagent from a gaseous phase occurs within the presence of a plasma source.

5. The method of claim 1 wherein said coated label comprises a label portion and a coating portion and wherein said coating portion is selected from epoxyamines, carbon-rich materials, and silicon-rich materials.

6. The method of claim 1 wherein said coated label is selected from an underside coated label, an outside coated label, and a dual side coated label.

7. The method of claim 1 wherein said coated label is a shrink-wrap dual side coated label and wherein said dual side coated label comprises a first coating and a second coating, wherein said first coating and said second coating are different.

8. The method of claim 7 wherein one of said first coating and said second coating comprises an epoxyamine and the other of said first coating and said second coating comprises either a silicon-rich material or a carbon-rich material.

9. The method of claim 1 wherein said coated label is a shrink-wrap label and said applying a coating mix to a label comprises applying a first thickness of said coating mix at a first position on said label and applying a second thickness of said coating mix at a second position on said label, wherein said first thickness and said second thickness are different.

10. The method of claim 1 further comprising:

cleaning said label using a cleaning liquid prior to application of said coating mix; and passing said label past a curing element that functions to increase the rate of curing of said coating mix.

11. The method of claim 1 wherein said coated label is a shrink-wrap dual side coated label and wherein said shrink-wrap dual side coated label comprises a first coating and a second coating;

wherein one of said first coating and said second coating comprises an epoxyamine and the other of said first coating and said second coating comprises a silicon-rich amorphous material made using plasma-enhanced deposition;

wherein said container has a barrier to carbon dioxide that allows less than about 1 cc/day of transport.

12. The method of claim 11 wherein said beverage comprises a carbonated soda and said coated label extends the life of said carbonated soda by about 10% to about 400%.

* * * * *